US007683879B2

(12) United States Patent
Yamase

(10) Patent No.: US 7,683,879 B2
(45) Date of Patent: Mar. 23, 2010

(54) LIQUID CRYSTAL DISPLAY DRIVE CIRCUIT

(75) Inventor: Shinya Yamase, Ota (JP); Kaoru Yamase, legal representative, Ota (JP)

(73) Assignee: Sanyo Electric Co., Ltd., Osaka (JP)

( * ) Notice: Subject to any disclaimer, the term of this patent is extended or adjusted under 35 U.S.C. 154(b) by 862 days.

(21) Appl. No.: 11/509,632

(22) Filed: Aug. 25, 2006

(65) Prior Publication Data

US 2007/0046598 A1 Mar. 1, 2007

(30) Foreign Application Priority Data

Aug. 25, 2005 (JP) ..... 2005-243810

(51) Int. Cl.
*G09G 3/36* (2006.01)
*G09G 5/00* (2006.01)

(52) U.S. Cl. ..... 345/100; 345/210; 345/204; 345/211

(58) Field of Classification Search ..... None
See application file for complete search history.

(56) References Cited

U.S. PATENT DOCUMENTS 6,133,897 A * 10/2000 Kouchi ..... 345/100
2006/0132344 A1* 6/2006 Ishii et al. ..... 341/144

FOREIGN PATENT DOCUMENTS

JP 11-510622 A 9/1999
WO WO-97/43750 A1 11/1997

* cited by examiner

*Primary Examiner*—Bipin Shalwala
*Assistant Examiner*—Daniel Bedell
(74) *Attorney, Agent, or Firm*—Morrison & Foerster LLP

(57) ABSTRACT

The number of transistors in an output control circuit is significantly reduced in a liquid crystal display drive circuit. Also, power consumption is reduced and a drive voltage is stabilized. A pair of control transistors is provided for each of four output transistors TR1-TR4, resulting in total of eight control transistors being provided. The eight control transistors are switched according to a dot signal DA and a field signal DF to select one output transistor out of the four output transistors TR1-TR4. Transition from ON to OFF of the output transistors is quickened by steepening rise of DFp and DFBp that are applied to gates of the output transistors and fall of DFn and DFBn that are applied to gates of the output transistors. Also, transition from OFF to ON is delayed by slackening fall of DFp and DFBp and rise of DFn and DFBn.

5 Claims, 5 Drawing Sheets

COMMON DRIVER UNIT

*FIG.2A* COMMON DRIVER UNIT
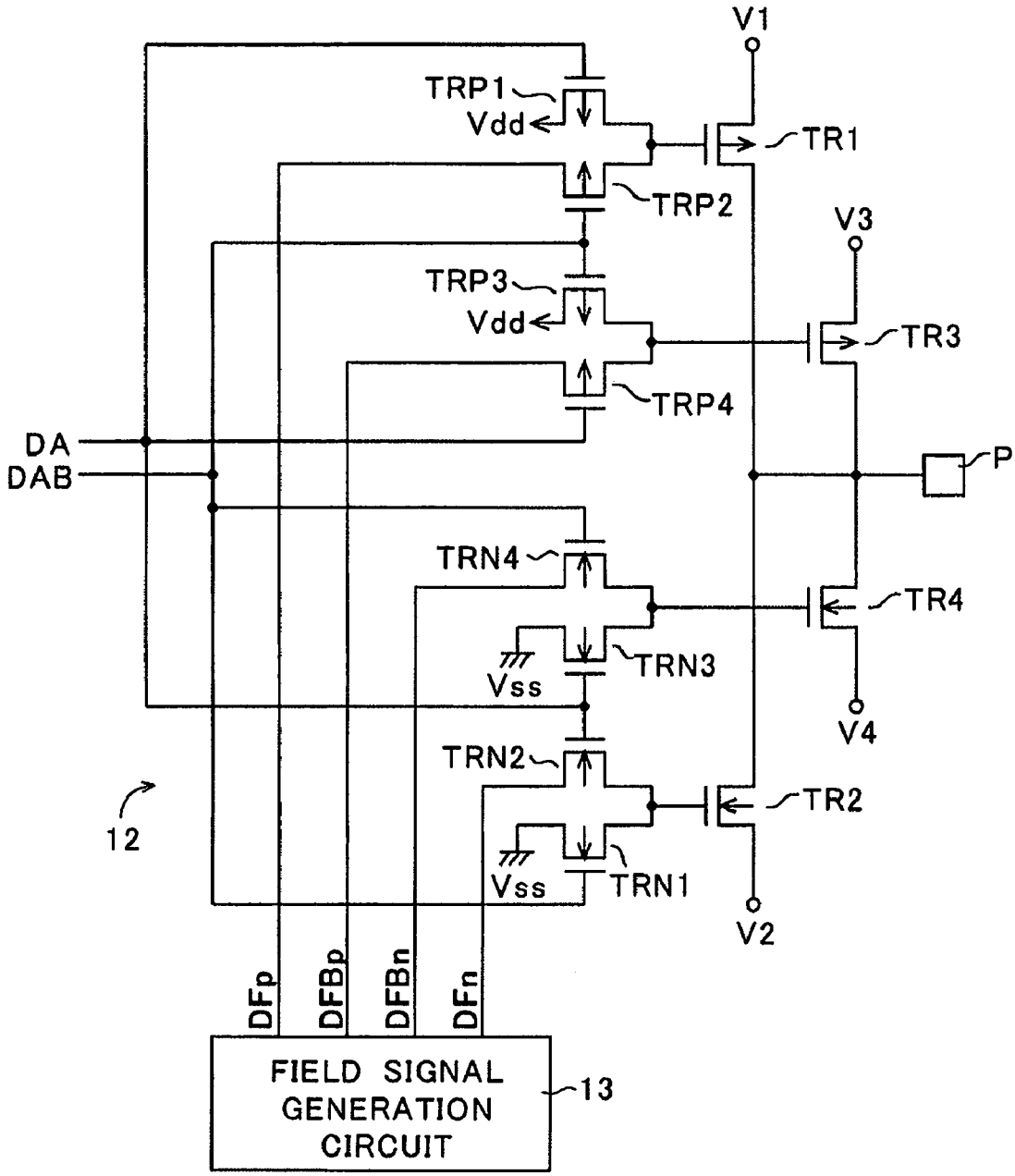

*FIG.2B* SEGMENT DRIVER UNIT
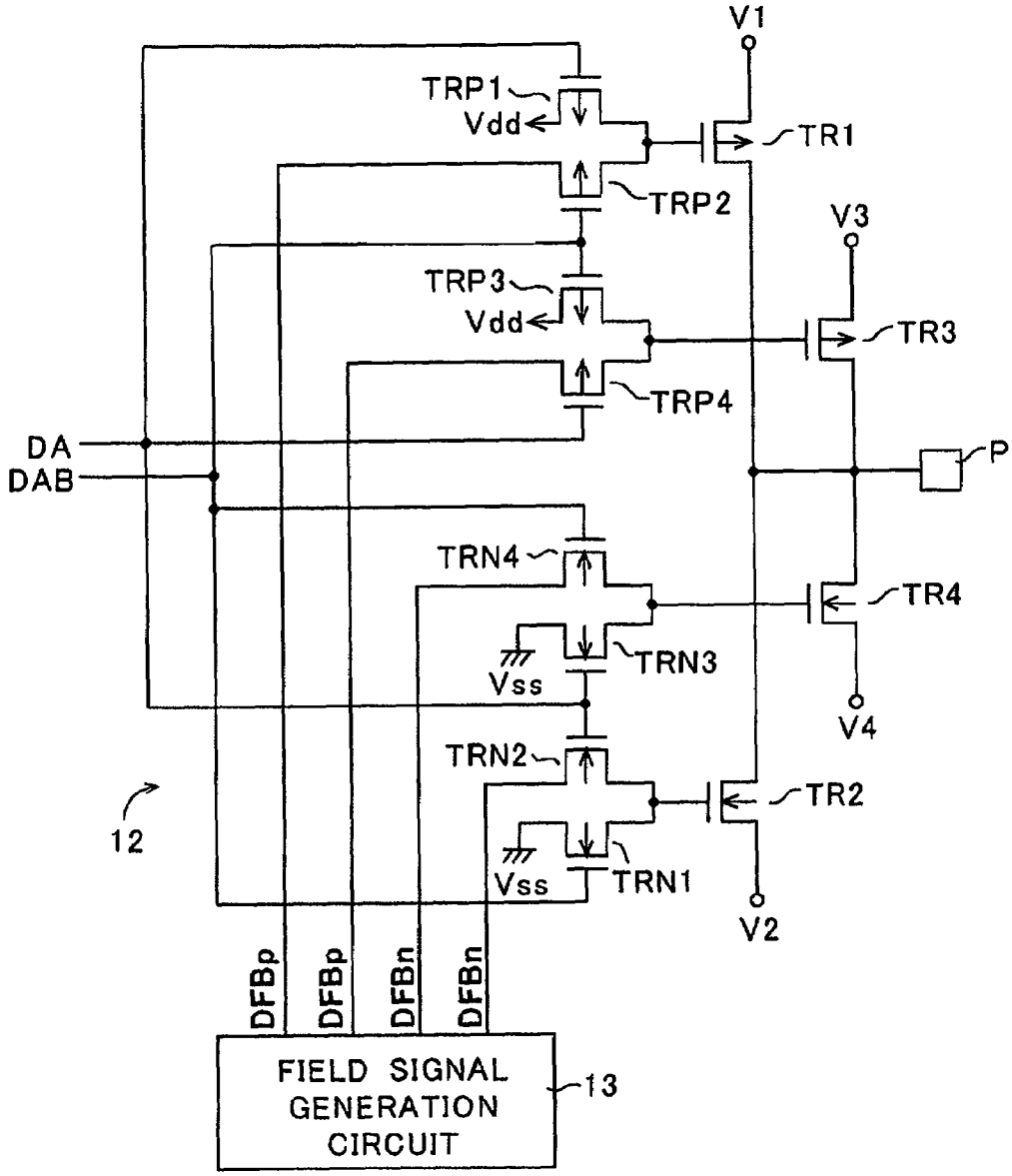

*FIG.4A* COMMON DRIVER
PRIOR ART
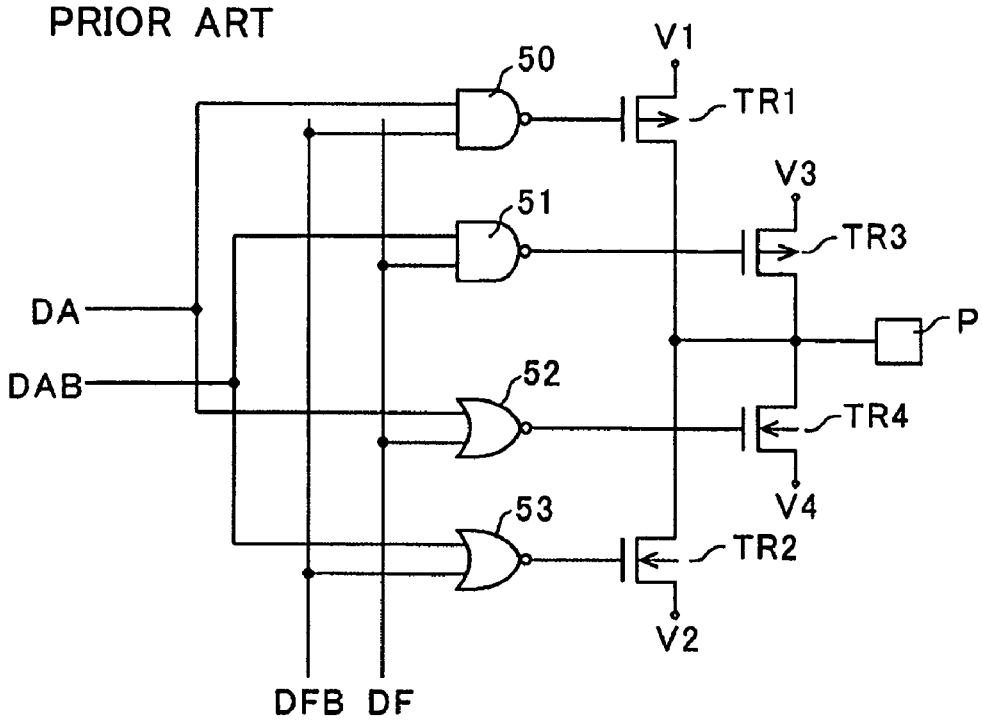
*FIG.4B* SEGMENT DRIVER
PRIOR ART
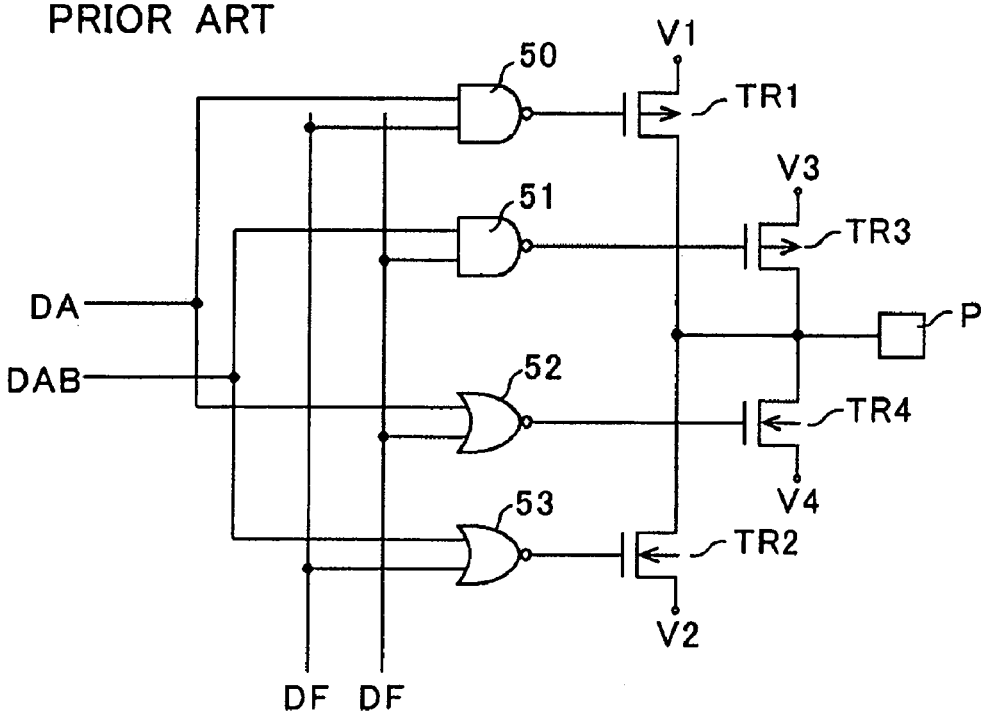

LIQUID CRYSTAL DISPLAY DRIVE CIRCUIT

CROSS-REFERENCE OF THE INVENTION

This application is based on Japanese Patent Application No. 2005-243810, the content of which is incorporated herein by reference in its entirety.

BACKGROUND OF THE INVENTION

1. Field of the Invention

This invention relates to a drive circuit for a liquid crystal display, specifically to a drive circuit for an STN-LCD (Super Twisted Nematic Liquid Crystal Display) panel.

2. Description of the Related Art

In general, the drive circuit for the STN-LCD panel is separated into two components, i.e., a common driver and a segment driver. Each of the common driver and the segment driver outputs multi-bit drive signals to corresponding data lines (row lines or column lines), has four output transistors per bit, and outputs one of four drive voltages V1, V2, V3 and V4 by turning on one of the four output transistors while turning off the other output transistors. A liquid crystal capacitor is formed at each of intersections of the row lines and the column lines. A dot matrix liquid crystal display is performed by applying the drive voltages across the liquid crystal capacitor.

FIG. 4A is a circuit diagram of an output control circuit for one bit of the common driver. The output control circuit of the common driver has a first output transistor TR1, to a source of which the first drive voltage V1 is applied, a second output transistor TR2, to a source of which the second drive voltage V2 is applied, a third output transistor TR3, to a source of which the third drive voltage V3 is applied and a fourth output transistor TR4, to a source of which the fourth drive voltage V4 is applied. Drains of the four output transistors TR1-TR4 are connected together to an output terminal P. The first and third output transistors TR1 and TR3 are P-channel type MOS transistors, while the second and fourth output transistors TR2 and TR4 are N-channel type MOS transistors.

A gate voltage of the first output transistor TR1 is controlled by an output of a first NAND circuit 50, a gate voltage of the third output transistor TR3 is controlled by an output of a second NAND circuit 51, a gate voltage of the fourth output transistor TR4 is controlled by an output of a first NOR circuit 52 and a gate voltage of the second output transistor TR2 is controlled by an output of a second NOR circuit 53.

A dot signal DA, that is a display signal, and a reverse field signal DFB, that is a reverse of a field signal DF, are inputted to the first NAND circuit 50, while a reverse dot signal DAB, that is a reverse of the dot signal DA, and the field signal DF are inputted to the second NAND circuit 51. The dot signal DA and the field signal DF are inputted to the first NOR circuit 52, while the reverse dot signal DAB and the reverse field signal DFB are inputted to the second NOR circuit 53.

The segment driver also has an output control circuit of the same structure as the common driver. However, the reverse field signal DFB that is inputted to the output control circuit of the common driver is replaced with the field signal DF in the output control circuit of the segment driver, as shown in FIG. 4B. A truth table of the output control circuits of the common driver and the segment driver is shown in Table 2.

TABLE 2

| | | COMMON DRIVER | | | | | SEGMENT DRIVER | | | | |
|---|---|---|---|---|---|---|---|---|---|---|---|
| | | TR1 | TR2 | TR3 | TR4 | | TR1 | TR2 | TR3 | TR4 | |
| DA | DF | $\overline{DA\ DF}$ | $\overline{DA+DF}$ | $\overline{DA\ DF}$ | DA+DF | OUTPUT | $\overline{DA\ DF}$ | $\overline{DA+DF}$ | $\overline{DA\ DF}$ | DA+DF | OUTPUT |
| L | L | H | L | H | H | V4 | H | L | H | H | V4 |
| L | H | H | L | L | L | V3 | H | L | L | L | V3 |
| H | L | L | L | H | L | V1 | H | H | H | L | V2 |
| H | H | H | H | H | L | V2 | L | L | H | L | V1 |

Further description on the technologies described above may be found in Japanese Patent Application Publication No. H11-510622, for example.

In the conventional liquid crystal display drive circuit, however, the number of transistors in the output control circuit is as many as 16, since on/off control of the output transistors are made by two NAND circuits (the first and second NAND circuits 50 and 51) and two NOR circuits (the first and second NOR circuits 52 and 53). It has caused a problem of an increased die size of an LSI that includes the drive circuit. The increase in the number of transistors has a large influence over the die size, especially because the drive voltages as high as 30V to 40V require using high withstand voltage transistors that consume large die area in designing not only the output transistors but also transistors forming the NAND circuits and the NOR circuits.

Also, a through current and a charge/discharge current in the NAND circuit, NOR circuit and output transistors are significantly increased during transition (from low to high, or from high to low) of the dot signal DA and the field signal DF, leading to an increased power consumption and fluctuations in the drive voltages.

SUMMARY OF THE INVENTION

This invention offers a liquid crystal display drive circuit that includes an output control circuit having four output transistors and a plurality of control transistors, a source of each of the output transistors being provided with each of four drive voltages, respectively, and drains of the output transistors being connected together to an output terminal, the plurality of control transistors selecting two output transistors out of the four output transistors according to a dot signal and a reverse dot signal that is a reverse of the dot signal, the plurality of control transistors selecting further selecting one output transistor out of the previously selected two output transistors according to a field signal and a reverse field signal that is a reverse of the field signal so as to output one of the four drive voltages.

Also, the output control circuit includes a pair of control transistors that complementarily turn on according to the dot signal and the reverse dot signal. The pair of control transistors is connected with a gate of one of the four output transistors and turns the output transistors off when one of the pair of control transistors is turned on and provides the gate of the output transistor with the field signal or the reverse field signal when the other of the pair of control transistors is turned on.

This invention also offers a liquid crystal display drive circuit that adjusts rising timing and falling timing of the field signal and the reverse field signal so that a through current is prevented from flowing through the output transistors during a transition period of the field signal or the reverse field signal.

BRIEF DESCRIPTION OF THE DRAWINGS

FIG. 2A is a circuit diagram of a common driver unit CDU in a common driver CD according to the embodiment of this invention. FIG. 2B is a circuit diagram of a segment driver unit SDU in a segment driver SD according to the embodiment of this invention.

FIG. 4A is a circuit diagram of an output control circuit for one bit of a common driver according to a prior art.

FIG. 4B is a circuit diagram of an output control circuit for one bit of a segment driver according to the prior art.

DETAILED DESCRIPTION OF THE INVENTION

Figure 1:
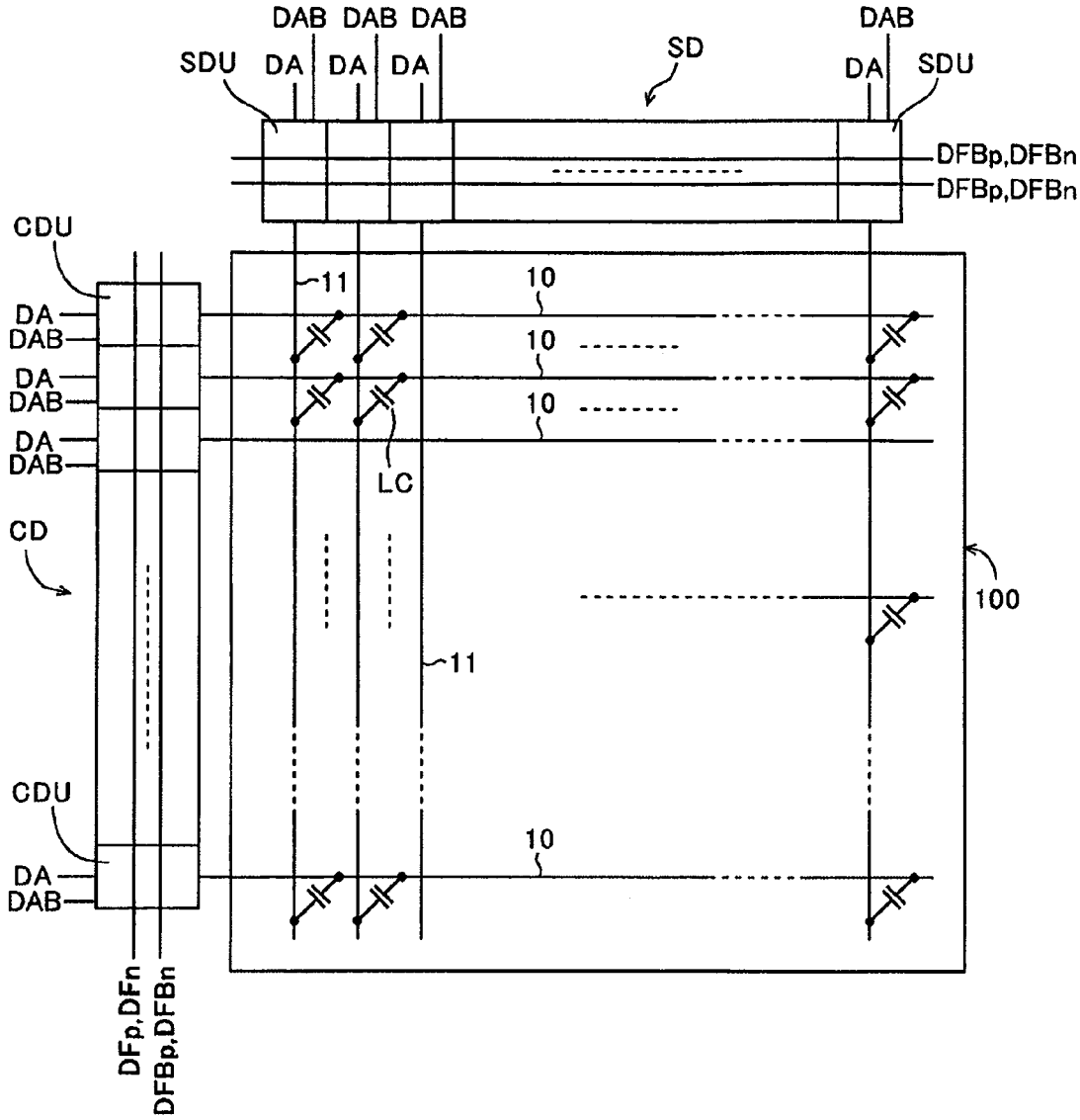
FIG. 1 shows a structure of a dot matrix type STN-LCD panel according to an embodiment of this invention.

Next, an embodiment of this invention will be explained referring to the figures hereinafter. FIG. 1 shows a structure of a dot matrix type STN-LCD panel according to the embodiment. A common driver CD and a segment driver SD are disposed on a periphery of a display region 100 in the STN-LCD panel. The common driver CD has a plurality of common driver units CDU that have the same circuit structure as each other. Each of the common driver units CDU is provided with a dot signal DA and a reverse dot signal DAB that is the reverse of the dot signal DA. The common driver units CDU are provided in common with field signals DFp and DFn and reverse field signals DFBp and DFBn that are the reverse of the field signals DFp and DFn. The segment driver SD has a plurality of segment driver units SDU that are the same in circuit structure as the common driver units SDU. However, the field signals DFp and DFn that are provided to the common driver units CDU are replaced with the reverse field signals DFBp and DFBn.

An output signal of each of the common driver units CDU is outputted to a corresponding row line 10, while an output signal of each of the segment driver units SDU is outputted to a corresponding column line 11. A liquid crystal capacitor LC is formed at each of intersections of the row lines 10 and the column lines 11. A liquid crystal display of black or white is performed according to a voltage of the row line 10 and a voltage of the column line 11.

FIG. 2A is a circuit diagram of one of the common driver units CDU in the common driver CD. Drains of four output transistors TR1-TR4 are connected together to an output terminal P. A first drive voltage V1 is applied to a source of the first output transistor TR1, a second drive voltage V2 is applied to a source of the second output transistor TR2, a third drive voltage V3 is applied to a source of the third output transistor TR3 and a fourth drive voltage V4 is connected to a source of the fourth drive transistor TR4. The first and third output transistors TR1 and TR3 are P-channel type MOS transistors, while the second and fourth output transistors TR2 and TR4 are N-channel type MOS transistors. The drains of the four output transistors TR1-TR4 are connected together to the output terminal P.

There is provided an output control circuit 12 that turns on only one of the four output transistors TR1-TR3 at a time. The output control circuit 12 is formed of eight control transistors. A drain of a first control transistor TRP1 and a drain of a second control transistor TRP2 are connected together to a gate of the first output transistor TR1. The dot signal DA is applied to a gate of the first control transistor TRP1, while a power supply voltage Vdd is applied to its source. The reverse dot signal DAB is applied to a gate of the second control transistor TRP2, while the field signal DFp is applied to its source.

A drain of a third control transistor TRP3 and a drain of a fourth control transistor TRP4 are connected together to a gate of the third output transistor TR3. The reverse dot signal DAB is applied to a gate of the third control transistor TRP3, while the power supply voltage Vdd is applied to its source. The dot signal DA is applied to a gate of the fourth control transistor TRP4, while the reverse field signal DFBp is applied to its source. Here, the first through fourth control transistors TRP1, TRP2, TRP3 and TRP4 are P-channel type MOS transistors. And the power supply voltage Vdd is equal to or higher than higher one of the first drive voltage V1 and the third drive voltage V3.

A drain of a fifth control transistor TRN1 and a drain of a sixth control transistor TRN2 are connected together to a gate of the second output transistor TR2. The reverse dot signal DAB is applied to a gate of the fifth control transistor TRN1, while a ground voltage Vss is applied to its source. The dot signal DA is applied to a gate of the sixth control transistor TRN2, while the field signal DFn is applied to its source.

A drain of a seventh control transistor TRN3 and a drain of an eighth control transistor TRN4 are connected together to a gate of the fourth output transistor TR4. The dot signal DA is applied to a gate of the seventh control transistor TRN3, while the ground voltage Vss is applied to its source. The reverse dot signal DAB is applied to a gate of the eighth control transistor TRN4, while the reverse field signal DFBn is applied to its source.

Here, the fifth through eighth control transistors TRN1, TRN2, TRN3 and TRN4 are N-channel type MOS transistors. And the ground voltage Vss is equal to or lower than lower one of the second drive voltage V2 and the fourth drive voltage V4.

And there is provided a field signal generation circuit 13 that generates field signals DFp and DFn and the reverse field signals DFBp and DFBn. While a logical value of DFp is equal to a logical value of DFn and a logical value of DFBp is equal to a logical value of DFBn, fall times and rise times of these signals are adjusted so as to prevent the through current in the output transistors, as will be described later.

Next, an operation of the common driver unit CDU described above will be explained referring to FIGS. 3A and 3B. Logical description of the operation is that two output transistors out of the first through fourth output transistors TR1-TR4 are selected according to the dot signal DA, and then one of the two output transistors is selected according to a field signal DF that represents the logical values of the field signals DFp and DFn.

Figure 3A:
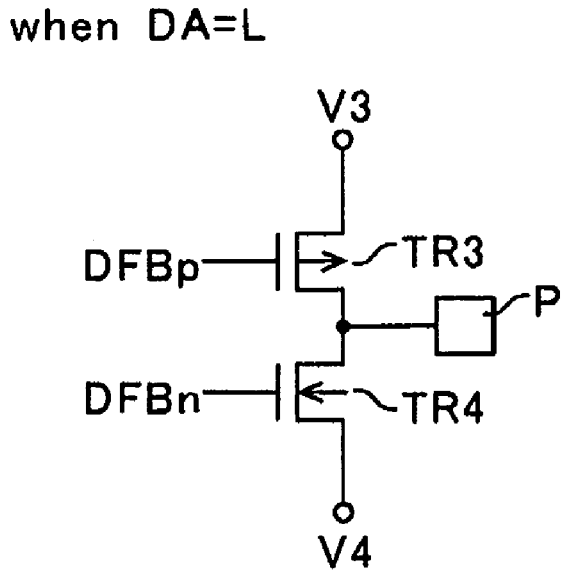
FIGS. 3A and 3B show operation of the common driver unit CDU in the common driver CD according to the embodiment of this invention.

Since TRP1 is turned on and TRP2 is turned off when the dot signal DA is low (L=Vss), a gate voltage of the first output transistor TR1 becomes high (H=Vdd) to turn off the first output transistor TR1. Also, since TRP3 is turned off and TRP4 is turned on, a gate voltage of the third output transistor TR3 becomes DFBp. Also, since TRN4 is turned on and TRN3 is turned off, a gate voltage of the fourth output transistor TR4 becomes DFBn. Also, since TRN2 is turned off and TRN1 is turned on, a gate voltage of the second output transistor TR2 becomes low to turn off the second output transistor TR2. As a result, when the dot signal DA is low (L=Vss), TR1 and TR2 are turned off, the gate voltage of TR3 becomes DFBp and the gate voltage of TR4 becomes DFBn, as shown in FIG. 3A. Since DFBp and DFBn take the same logical value that is represented by a logical value of DFB, one of the drive voltages V3 and V4 is selected and outputted to the output terminal P according to the logical value of DFB.

Figure 3B:
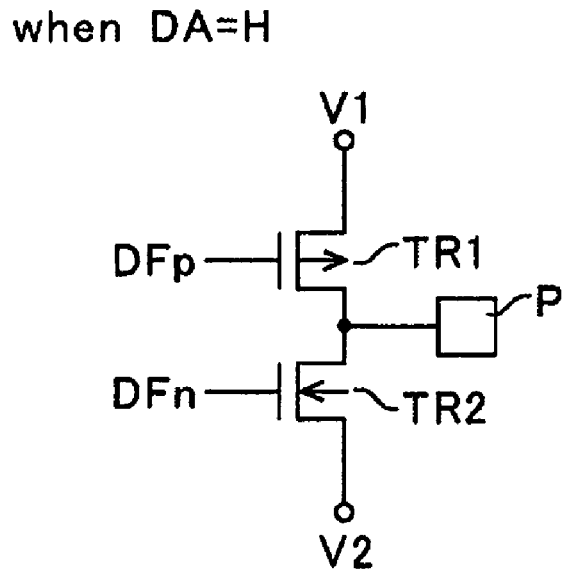

Next, when the dot signal DA is high (H=Vdd), the gate voltage of the first output transistor TR1 becomes DFp, since TRP1 is turned off and TRP2 is turned on. Also, since TRP3 is turned on and TRP4 is turned off, the gate voltage of the third output transistor TR3 becomes high to turn off the third output transistor TR3. Also, since TRN4 is turned off and TRN3 is turned on, the gate voltage of the fourth output transistor TR4 becomes low to turn off the fourth output transistor TR4. Also, since TRN2 is turned on and TRN1 is turned off the gate voltage of the second output transistor TR2 becomes DFn. As a result, when the dot signal DA is high (H=Vdd), TR3 and TR4 are turned off, the gate voltage of TR1 becomes DFp and the gate voltage of TR2 becomes DFn, as shown in FIG. 3B. Since DFp and DFn take the same logical value that is represented by a logical value of DF, one of the drive voltages V1 and V2 is selected and outputted to the output terminal P according to the logical value of DF.

The segment driver unit SDU has the same circuit structure as the common driver unit CDU. However, each of the field signals DFp and DFn that are inputted to the common driver unit CDU is replaced with each of the reverse field signals DFBp and DFBn, respectively, in the segment driver unit SDU, as shown in FIG. 2B. A truth table of the common driver unit CDU and the segment driver unit SDU resulting from the operation described above is shown in Table 1.

TABLE 1

| | | COMMON DRIVER | | | | | SEGMENT DRIVER | | | | |
|---|---|---|---|---|---|---|---|---|---|---|---|
| DA | DF | TR1 | TR2 | TR3 | TR4 | OUTPUT | TR1 | TR2 | TR3 | TR4 | OUTPUT |
| L | L | H | L | H | H | V4 | H | L | H | H | V4 |
| L | H | H | L | L | L | V3 | H | L | L | L | V3 |
| H | L | L | L | H | L | V1 | H | H | H | L | V2 |
| H | H | H | H | H | L | V2 | L | L | H | L | V1 |

In logical value, DFp = DFn = DF, DFBp = DFBn = DFB

Next, regarding timing of the signals, transition of the gate voltages of the first through fourth output transistors TR1-TR4 is determined by signal capabilities of the field signals DFp and DFn and the reverse field signals DFBp and DFBn, driving capabilities of the control transistors TRP2, TRP4, TRN2 and TRN4, gate capacitances of the first through fourth output transistors TR1-TR4 and wiring capacitances. Dominant factors among them are the signal capabilities of the field signals DFp and DFn and the reverse field signals DFBp and DFBn. Therefore, the through current in each of the output transistors TR1-TR4 can be prevented from flowing by steepening rises of DFp and DFBp and falls of DFn and DFBn to quicken the transition from ON to OFF of each of the output transistors TR1-TR4 and slackening falls of DFp and DFBp and rises of DFn and DFBn to delay the transition from OFF to ON of each of the output transistors TR1-TR4.

It is also possible to prevent the through current during a transition period of the dot signal DA by keeping DFp and DFBp at the high (H) level and DFn and DFBn at the low (L) level by the field signal generation circuit 13 to turn off the output transistors TR1-TR4 throughout the transition period of the dot signal DA.

With the liquid crystal display drive circuit of the embodiment of this invention, the output control circuit can be formed only with a plurality of control transistors without using NAND circuits or NOR circuits, to significantly reduce the number of transistors compared with the prior art. Also, the through current in the output transistors can be prevented from flowing to reduce the power consumption and to stabilize the drive voltage by adjusting the timing of the rise and fall of the field signals and the reverse field signals.

What is claimed is:

1. A liquid crystal display drive circuit comprising:

four output transistors receiving four drive voltages collectively, each of the four output transistors comprising a source receiving a corresponding one of the four drive voltages;

an output terminal connected to drains of the four output transistors; and an output control circuit comprising a plurality of control transistors, the output control circuit being configured to select two output transistors out of the four output transistors according to a dot signal and a reverse dot signal that is a reverse of the dot signal and to select one output transistor out of the two selected output transistors according to a field signal and a reverse field signal that is a reverse of the field signal so that one of the four drive voltages is outputted to the output terminal, wherein the output control circuit comprises a pair of control transistors that complementarily turn on according to the dot signal and the reverse dot signal, the pair of control transistors is connected with a gate of one of the four output transistors, the one of the four output transistors is configured to turn off when one of the pair of control transistors is turned on and is further configured to receive the field signal or the reverse field signal at the gate thereof when another of the pair of control transistors is turned on.

2. The liquid crystal display drive circuit of claim 1, wherein the display device is configured so as to reduce a through current flowing through the output transistors during a transition period of the field signal or the reverse field signal by adjusting a rising timing of the field signal or the reverse field signal or a falling timing of the field signal or the reverse field signal.

3. A liquid crystal display drive circuit comprising:

four output transistors receiving four drive voltages collectively, each of the four output transistors comprising a source receiving a corresponding one of the four drive voltages;

an output terminal connected to drains of the four output transistors; and an output control circuit comprising a plurality of control transistors, the output control circuit being configured to select two output transistors out of the four output transistors according to a dot signal and a reverse dot signal that is a reverse of the dot signal and to select one output transistor out of the two selected output transistors according to a field signal and a reverse field signal that is a reverse of the field signal so that one of the four drive voltages is outputted to the output terminal, wherein a logical level of the field signal and a logical level of the reverse field signal are maintained during a transition period of the dot signal so that the four output transistors are turned off during the transition period.

4. The liquid crystal display drive circuit of claim 1, wherein a logical level of the field signal or the reverse field signal is maintained during a transition period of the dot signal so that the output transistor is turned off during the transition period.

5. The liquid crystal display drive circuit of claim 2, wherein a logical level of the field signal or the reverse field signal is maintained during a transition period of the dot signal so that the output transistor is turned off during the transition period.

* * * * *